US008441201B2

(12) United States Patent
Aso

(10) Patent No.: US 8,441,201 B2
(45) Date of Patent: May 14, 2013

(54) LED DRIVING APPARATUS

(75) Inventor: Shinji Aso, Saitama (JP)

(73) Assignee: Sanken Electric Co., Ltd., Saitama (JP)

( * ) Notice: Subject to any disclaimer, the term of this patent is extended or adjusted under 35 U.S.C. 154(b) by 215 days.

(21) Appl. No.: 13/083,009

(22) Filed: Apr. 8, 2011

(65) Prior Publication Data

US 2011/0248638 A1 Oct. 13, 2011

(30) Foreign Application Priority Data

Apr. 9, 2010 (JP) ..... 2010-090834

(51) Int. Cl.
*H05B 41/16* (2006.01)

(52) U.S. Cl.
USPC ..... 315/276

(58) Field of Classification Search ..... 315/141, 315/177–178, 212, 220, 254, 255, 266, 276, 315/277, 307, 185 R, 690, 291, 102, 289, 315/201, 294, 297, 312, 224
See application file for complete search history.

(56) References Cited

U.S. PATENT DOCUMENTS

2004/0004446 A1* 1/2004 Liu ..... 315/224
2006/0255753 A1* 11/2006 Sawada et al. ..... 315/312
2009/0195169 A1* 8/2009 Huang et al. ..... 315/193
2009/0237007 A1* 9/2009 Leng ..... 315/297
2009/0295776 A1* 12/2009 Yu et al. ..... 345/212
2010/0237799 A1* 9/2010 Choi et al. ..... 315/294
2011/0101876 A1* 5/2011 Jheng et al. ..... 315/201
2011/0140630 A1* 6/2011 Doudousakis et al. ..... 315/291

FOREIGN PATENT DOCUMENTS

JP 2004319583 11/2004

* cited by examiner

*Primary Examiner* — Thienvu Tran
(74) *Attorney, Agent, or Firm* — Wilmer Cutler Pickering Hale and Dorr LLP

(57) ABSTRACT

An LED driving apparatus comprises a power supply unit that includes a transformer having a primary coil and a plurality of secondary coils and outputs alternating power from the plurality of secondary coils; a current balancing unit and a first rectification smoothing unit connected to a first secondary coil of the plurality of secondary coils; an LED load group that includes a plurality of LEDs connected in series and to which power smoothed from the first rectification smoothing unit is supplied; a power control unit that controls power to be supplied to the first and second LED loads, based on currents flowing in the first and second LED loads; and a direct current load that is connected to both ends of a second secondary coil of the plurality of secondary coils. The power supplying unit controls the alternating power, based on the power supplied to the direct current load.

6 Claims, 8 Drawing Sheets

LED DRIVING APPARATUS

CROSS-REFERENCE TO RELATED APPLICATIONS

This application claims priority from Japanese Patent Application No. 2010-090834 filed on Apr. 9, 2010, the entire subject-matter of which is incorporated herein by reference.

BACKGROUND OF THE INVENTION

1. Field of the Invention

The present invention relates to a light emitting diode (LED) driving apparatus. More specifically, the present invention relates to an LED driving apparatus that supplies power to an LED load and other load.

2. Description of the Related Art

There has been proposed an LED driving apparatus that drives a plurality of LEDs connected in series (for example, refer to JP-A-2004-319583).

According to the LED driving apparatus disclosed in JP-A-2004-319583, a plurality of LED load groups (LED strings), each of which has a plurality of LED devices connected in series, is connected in parallel. However, since the LED devices have different forward voltages Vf, respectively, when they are driven with the LED load groups being connected in parallel, currents flowing in the respective LED load groups are unbalanced. Accordingly, in JP-A-2004-319583, constant current circuits corresponding to each of the LED load groups are provided to control the currents flowing in each of the LED load groups, thereby balancing the currents flowing in the LED load groups.

However, according to the related-art LED driving apparatus, the constant current circuits are required in correspondence to the parallel number of LED load groups, so that the LED driving apparatus is enlarged and the cost thereof is increased. Furthermore, the related-art LED driving apparatus has not considered supplying power to other load in addition to the LED loads.

SUMMARY OF THE INVENTION

In order to solve the above-described problems, aspects of the invention configure an LED driving apparatus simply and at a low cost, which can balance currents flowing in each of LED load groups while securing power to be supplied to LED load groups and other loads.

According to one aspect of the invention, there is provided an LED driving apparatus comprising: a power supplying unit, which includes a transformer having a primary coil and a plurality of secondary coils, and which outputs alternating power from the plurality of secondary coils; a first series connector that is configured by a first coil and a first rectification smoothing circuit connected to a first secondary coil of the plurality of secondary coils; a first LED load, which includes a plurality of LEDs connected in series, and to which power smoothed from the first rectification smoothing circuit is supplied; a second series connector that is configured by a second coil and a second rectification smoothing circuit connected to the first secondary coil; a second LED load, which includes a plurality of LEDs connected in series, and to which power smoothed from the second rectification smoothing circuit is supplied; a power control unit that controls power to be supplied to the first and second LED loads based on currents flowing in the first and second LED loads; and a direct current load that is connected to both ends of a second secondary coil of the plurality of secondary coils, wherein the first and second coils are electromagnetically coupled to each other, and wherein the power supplying unit controls the alternating power based on the power supplied to the direct current load.

According to the LED driving apparatus of the invention, the power is supplied from a plurality of secondary coils, which configure the transformer of the power supply unit, to the LED load groups and other direct current load. Furthermore, since the first and second coils, which are connected to the first and second LED loads and the first and second rectification smoothing circuits, are electromagnetically coupled to each other, the currents flowing in the first and second LED loads are balanced. Accordingly, it is possible to provide an LED driving apparatus, which can balance the currents flowing in each of the LED load groups while securing power to be supplied to the LED load groups and other loads. Further, it is possible to configure such an LED driving apparatus simply and at a low cost.

DETAILED DESCRIPTION OF THE PREFERRED EMBODIMENTS

Figure 1:
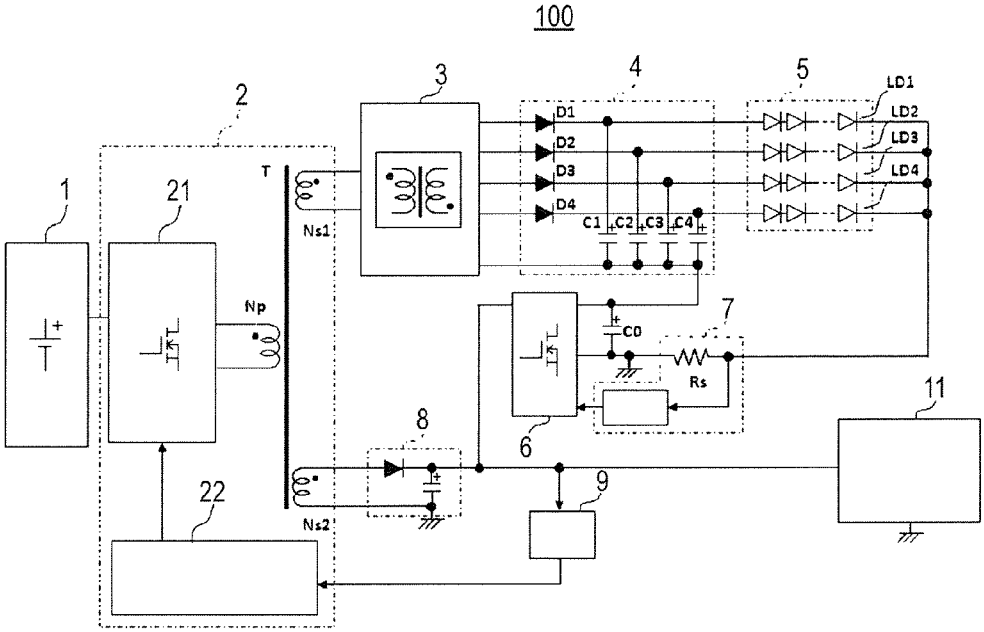
FIG. 1 is a circuit diagram of an LED driving apparatus according to a first illustrative embodiment of the invention.

Hereinafter, an LED driving apparatus of illustrative embodiments of the invention will be described with reference to the drawings. In the drawings, the same or similar parts are indicated with the same or similar reference numerals. The drawings are schematic and are different from the actual apparatus. In addition, the parts having different sizes or ratios in the drawings may be included.

First Illustrative Embodiment

FIG. 1 is a circuit diagram of an LED driving apparatus 100 according to a first illustrative embodiment of the invention. The LED driving apparatus 100 includes a transformer T having a primary coil Np and secondary coils Ns1, Ns2, a power supplying unit 2, a current balancing unit 3 having first and second coils that are connected to the secondary coil Ns1 and are electromagnetically coupled to each other, a first rectification smoothing unit 4 having first and second rectification smoothing circuits, a LED load group 5 having a plurality of LED loads, a power control unit 6 that controls power to be supplied to the LED load group 5, and a direct current load 11.

The LED driving apparatus 100 of this illustrative embodiment drives the LED load group including LED loads LD1 to LD4 of four systems. Since LED devices configuring the respective LED loads have different forward voltages Vf, the respective LED loads LD1 to LD4 have different impedances, respectively.

A direct current power supply 1 consists of a direct current power supply such as battery or a well-known direct current power supply that is obtained from an alternating current power supply such as commercial power supply through a rectification smoothing circuit.

The power supplying unit 2 includes a switching circuit 21 having a switching device, a switch control unit 22 and the transformer T. The switching circuit 21 is connected to the direct current power supply 1. The switching circuit 21 turns on and off the switching device by a control signal based on power to be supplied to the direct current load so as to convert a direct current voltage from the direct current power supply 1 into an alternating current voltage (alternating voltage) of high frequency and supply the alternating current voltage to the primary coil Np of the transformer T. The alternating current voltage supplied to the primary coil Np is supplied, as an output voltage of the power supplying unit 2, from a first secondary coil Ns1 of the transformer T to the current balancing unit 3 and from a second secondary coil Ns2 to a second rectification smoothing unit 8. In other words, the power supplying unit 2 outputs a plurality of alternating current powers depending on a turn ratio between the secondary coils Ns1 and Ns2 through a single transformer T.

Figure 2A:
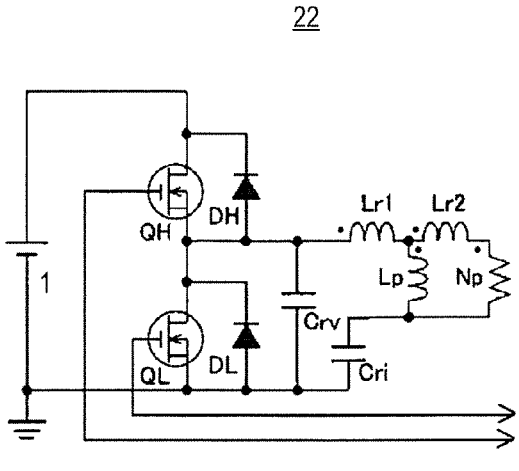
FIG. 2A is a detailed circuit diagram of a switching circuit.
Figure 2B:
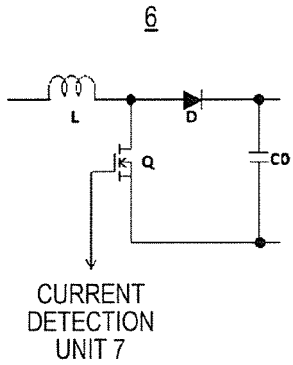
FIG. 2B is a detailed circuit diagram of a power control unit.

FIG. 2A a detailed circuit diagram of the switching circuit 21 and FIG. 2B is a detailed circuit diagram of the power control unit 6. The power supplying unit 2 consists of a resonant type switching power supply apparatus, for example. Specifically, in order to supply alternating current of a sinusoidal waveform, a series circuit configured by a switching device QH consisting of MOSFET and a switching device QL consisting of MOSFET is connected to both ends of the direct current power supply 1. A connection point of the switching device QH and the switching device QL is connected with a series resonant circuit configured by the primary coil Np of the transformer T and a current resonant capacitor Cri. The transformer T has leakage inductances Lr1, Lr2. Lp indicates magnetizing inductance of the transformer T. As the switching device QL and the switching device QH alternately turns on and off, the alternating current of a sinusoidal waveform, which is resonated by the leakage inductances Lr1, Lr2 and the current resonant capacitor Cri, is supplied from the secondary coils Ns1, Ns2 of the transformer T.

The current balancing unit 3 outputs the alternating current, which is supplied from the first secondary coil Ns1 of the transformer T, to the first rectification smoothing unit 4 from a plurality of output terminals. The current balancing unit 3 consists of a plurality of coils corresponding to the plurality of LED loads. In addition, as described above, in order to balance the currents flowing in the respective LED loads LD1 to LD4 having different impedances, the plurality of coils is electromagnetically coupled to each other.

The first rectification smoothing unit 4 rectifies and smoothes the alternating current power balanced by the current balancing unit 3 and outputs the rectified and smoothened alternating current power as direct current power to the LED load group 5. The first rectification smoothing unit 4 consists of diodes D1 to D4 and capacitors C1 to C4 corresponding to the plurality of LED loads. Incidentally, the '+' symbol given to the capacitor indicates an anode. Each of the anodes of the diodes D1 to D4 configuring the first rectification smoothing unit 4 is connected to a respective one of terminals of the current balancing unit 3, and each of cathodes of the diodes D1 to D4 is connected to a respective one of one terminals (anodes) of the capacitors C1 to C4 and the LED loads 5. Other terminals (cathodes) of the capacitors C1 to C4 are connected to an output terminal of the power control unit 6.

As described above, the LED load group 5 has the LED loads LD1 to LD4 having different impedances and configures an illumination module and a backlight module of an LED display apparatus or liquid crystal television. Each of the LED loads LD1 to LD4 has a configuration in which the same number of white LEDs is connected in series, for example. In FIG. 1, the parallel number of LED loads is four. However, the invention is not limited thereto. Further, the series number of white LEDs configuring the LED loads may be arbitrary.

The current detection unit 7 has a detection resistance Rs, which is connected to cathodes of the LED loads LD1 to LD4, and an error amplifier (operational amplifier) and a PWM comparator. The detection resistance Rs detects the currents flowing in the respective LED loads LD1 to LD4 at a time and outputs the detected currents to the error amplifier. The error amplifier outputs a difference between the current output from the detection resistance Rs and a predetermined current value as a current detection signal. The PWM comparator outputs a pulse signal whose duty ratio (ON width) or frequency varies depending on a magnitude of the current detection signal. Incidentally, the detection resistance Rs may be replaced by a known current transformer. A known error amplifier may be used for the error amplifier. The predetermined current value may be an arbitrary fixed value or a variable value that is changed in response to an external signal (not shown).

The power control unit 6 controls, based on the pulse signal of the current detection unit 7, the currents flowing in the LED load group, so as to adjust brightness of the LED devices. As shown in FIG. 2B, the power control unit 6 consists of a boost chopper circuit having a reactor L, a switching device Q and a diode D, for example. One end of the reactor L is connected to an output terminal of the second rectification smoothing unit 8, and the other end of the reactor L is connected to an anode of the diode D and one terminal of the switching device Q. A cathode of the diode D is connected to one end of a capacitor C0 and the capacitors C1 to C4 of the first rectification smoothing unit 4. Another terminal of the switching device Q is connected to the other end of the capacitor C0 and is connected (grounded) to the ground. A ground potential of this illustrative embodiment is, for example, a potential of a housing that supports the LED driving apparatus. A control terminal of the switching device Q is connected to the current detection unit 7, so that the current detection signal is input thereto. In other words, an input terminal of the power control unit 6 is connected to the output terminal of the second rectification smoothing unit 8, and the output terminal of the power control unit 6 is connected to the first rectification smoothing unit 4. The power control unit 6 of this illustrative embodiment controls the switching device Q to be turned on and off in response to the pulse signal output from the current detection unit 7, converts the output voltage of the second rectification smoothing unit 8 and controls voltage across the capacitor C0 so as to boost each voltage across the respective capacitors C1 to C4 of the first rectification smoothing unit 4 and control the LED load group 5 with desired brightness.

The second rectification smoothing unit 8 rectifies and smoothes the alternating current voltage, which is supplied from the first secondary coil Ns1 of the transformer T, and outputs the rectified and smoothened alternating current voltage as direct current power to the power control unit 6 and the direct current load 11. The second rectification smoothing unit 8 consists of diodes and capacitors, like the first rectification smoothing unit 4.

The direct current load 11 configures a liquid crystal driver or image processing circuit of a liquid crystal television, a control circuit of an LED display apparatus, a peripheral device and the like, for example.

The load voltage detection unit 9 detects the output voltage of the second rectification smoothing unit 8 and outputs a difference with respect to a first or second reference value to the switch control unit 22 as a voltage detection signal. In other words, by the voltage detection signal fed back to the switch control unit 22, the switch control unit 22 controls the switching devices QH, QL configuring the switching circuit 21 to maintain the output voltage of the second rectification smoothing unit 8 at a desired voltage.

Figure 3:
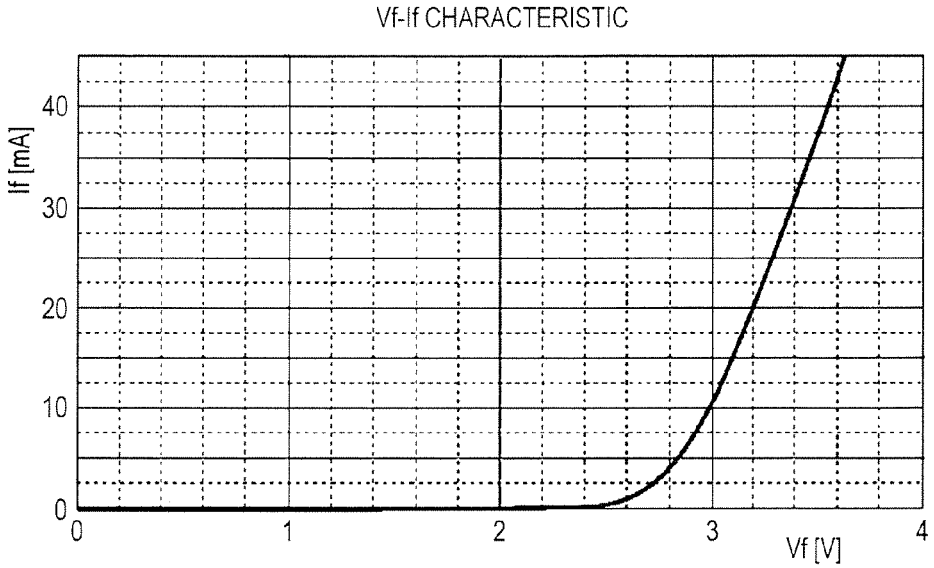
FIG. 3 shows a Vf-If characteristic of an LED.

Here, a characteristic of forward voltage Vf and forward current If of an LED is described. FIG. 3 is a specific example showing a characteristic of the forward voltage Vf-forward current If of an LED. As shown in FIG. 3, when the LED is under certain voltage Vf or less, the LED generally exhibits the characteristic that the forward current If becomes about 0 A. In FIG. 3, when the forward voltage Vf becomes about 2.4V or less, the flowing forward current If is very small (about 0 A).

Accordingly, when it is desired to turn off the LED loads LD1 to LD4, the voltage of the first secondary coil Ns1 or second secondary coil Ns2 wound on the same transformer T as the first secondary coil Ns1 is smoothed by the second rectification smoothing unit 8, and is then voltage-controlled by the power control unit 6, so that the voltage, which has been rectified and smoothed from the first secondary coil Ns1 through the current balancing unit 3, is made to be voltage (in the characteristic shown in FIG. 3, 2.4V or less (for example, 2V) for each LED) at which the current does not flow in the LED loads LD1 to LD4. As a result, the LED loads LD1 to LD4 can be turned off.

On the other hand, when it is desired to turn on the LED loads LD1 to LD4, the voltage is made to be voltage by the power control unit 6, at which the current flows in the LED device, for example about 3.4V for each LED device, so that the current of about 30 mA is enabled to flow to the LED device. As a result, the LED loads LD1 to LD4 can be turned on.

As shown in FIG. 1, the switch control unit 22 configuring the power supplying unit 2 is input with the voltage detection signal from the load voltage detection unit 9. When turning off the LED loads LD1 to LD4, the switch control unit 22 controls the switching circuit 21 so that the voltage detection signal is close to the first reference value. In addition, when turning off the LED loads LD1 to LD4, the switch control unit 22 controls the switching circuit 21 so that the voltage detection signal is close to the second reference value. In this illustrative embodiment, the switch control unit 22 is configured to modulate the operating frequencies of the switching devices QH, QL in response to the voltage detection signal. Incidentally, the first reference value is greater than the second reference value.

The LED driving apparatus 100 of this illustrative embodiment has following advantages.

(1) The power supplying unit 2 controls the output voltage of the second rectification smoothing unit 8 that supplies power to the direct current load 11. At the same time, the power supplying unit 2 also controls each voltage across the respective capacitors C1 to C4 of the first rectification smoothing unit 4 depending on a turn ratio of each coil. Furthermore, the power control unit 6 controls (boosts) each voltage of the respective capacitors C1 to C4 of the first rectification smoothing unit 4 in response to the current flowing in the LED load group 5 so as to control the brightness of the LED load group 5.

(2) Currents flowing in a plurality of coils that are electromagnetically coupled are balanced by an interaction between each magnetic flux generated by respective currents. Accordingly, the current balancing unit 3 can output the balanced currents. Therefore, it is possible to reduce variation in brightness of the LED loads LD1 to LD4.

(3) Since the currents flowing in the LED loads LD1 to LD4 are balanced, it is possible to precisely control the currents flowing in LEDs by using a single current detection unit 7 without adding additional power control unit 6 and additional current detection unit 7 in spite of the number of LED loads. Accordingly, it is possible to reduce a size of the LED control apparatus and to provide the LED control apparatus at a low cost.

(4) Since the power control unit 6 and the capacitor C0 are configured to boost each voltage across the respective capacitors C1 to C4, the voltage applied to the LED load group 5 is divided to the capacitors C1 to C4 and the capacitor C0. Therefore, it is possible to adopt small and inexpensive parts (i.e., low-voltage parts) for the capacitors. Accordingly, it is possible to reduce the size of the LED control apparatus and to provide the LED control apparatus at a low cost.

(5) The power supplying unit 2 can supply a plurality of output powers depending on the turn ratio of each coil of the transformer T to the LED load group 5 and the direct current load 11 by using a single transformer T. Therefore, it is possible to reduce a number of parts of the LED control apparatus and to simplify a circuit configuration of the LED control apparatus. Accordingly, it is possible to reduce the size of the LED control apparatus and to provide the LED control apparatus at a low cost.

(6) The LED load group 5 and the current detection unit 7 are provided to a secondary side of the transformer T. In addition, the power control unit 6 is also provided to the secondary side of the transformer T. Therefore, it is possible to control the currents without using an insulation-type signal transmission element. Accordingly, the power control unit 6 can quickly response to the currents flowing in the LED load group 5, and it is possible to simplify a circuit configuration of the power control unit 6 and the current detection unit 7.

Second Illustrative Embodiment

Figure 4:
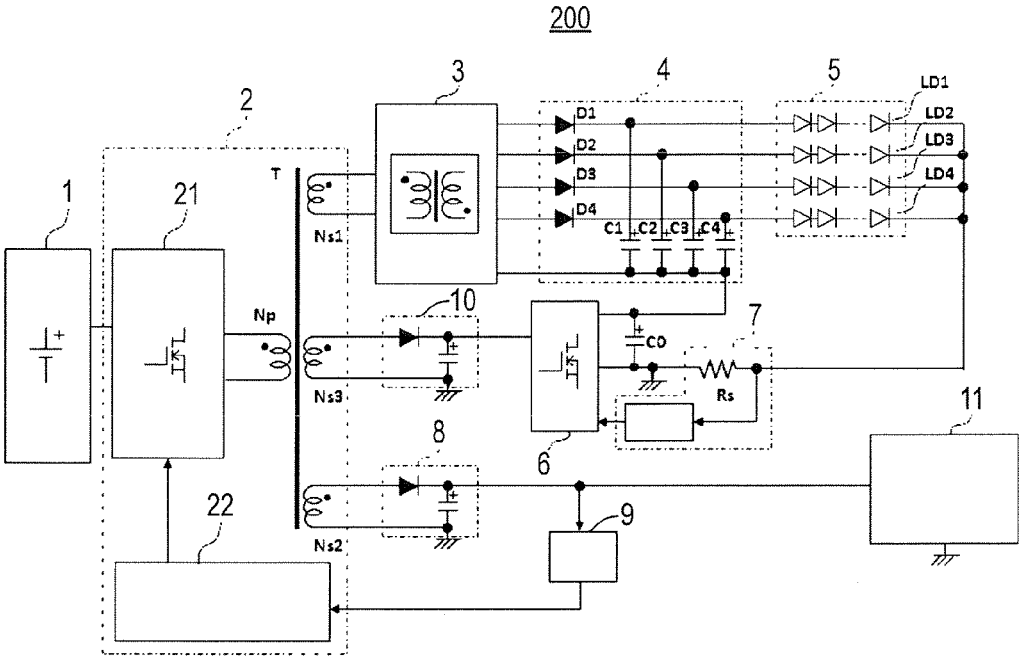
FIG. 4 is a circuit diagram of an LED driving apparatus according to a second illustrative embodiment of the invention.

FIG. 4 is a circuit diagram of an LED driving apparatus 200 according to a second illustrative embodiment of the invention. The LED driving apparatus 200 is different from the LED driving apparatus 100 of the first illustrative embodiment in that a third secondary coil Ns3 and a third rectification smoothing unit 10 are added, and the third rectification smoothing unit 10 and the power control unit 6 are connected. In other words, the second secondary coil Ns2 and the second rectification smoothing unit 8 supply the power to the direct current load 11, and the third secondary coil Ns3 and the third rectification smoothing unit 10 supply the power to the power control unit 6.

The third rectification smoothing unit 10 rectifies and smoothes the alternating current voltage, which is supplied from the third secondary coil Ns3 of the transformer T, and outputs the rectified and smoothened alternating current voltage as direct current power to the power control unit 6. The third rectification smoothing unit 10 consists of diodes and capacitors, like the second rectification smoothing unit 8.

The power control unit 6 has a boost chopper circuit, like the first illustrative embodiment, and one end of the reactor L is connected to the output terminal of the third rectification smoothing unit 10. The power control unit 6 of this illustrative embodiment converts the output voltage of the third rectification smoothing unit 10 in response to the current detection signal to control voltage across the capacitor C0 so as to control (boost) the LED load group 5 with desired brightness.

The LED driving apparatus 200 of this illustrative embodiment can control the brightness of the LED load group 5 and balance the currents flowing in the respective LED loads LD1 to LD4, like the LED driving apparatus 100 of the first illustrative embodiment.

Third Illustrative Embodiment

Figure 5:
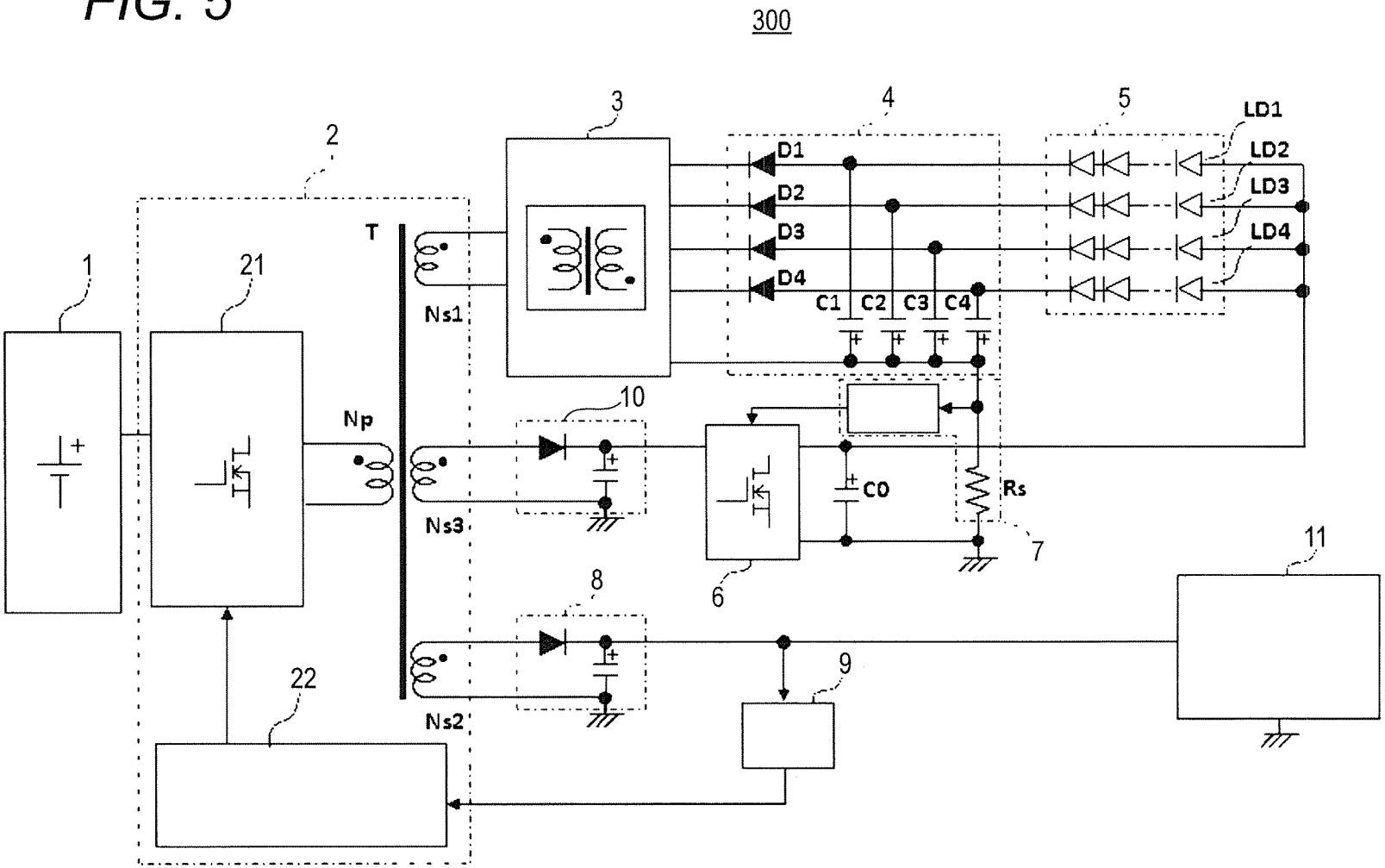
FIG. 5 is a circuit diagram of an LED driving apparatus according to a third illustrative embodiment of the invention.

FIG. 5 is a circuit diagram of an LED driving apparatus 300 according to a third illustrative embodiment of the invention. The LED driving apparatus 300 is different from the LED driving apparatus 200 of the second illustrative embodiment in that the diodes D1 to D4 and capacitors C1 to C4 configuring the first rectification smoothing unit 4 and the LED loads LD1 to LD4 are reversely connected with respect to the polarities thereof, the output terminal of the power control unit 6 is connected to the LED load group 5, and the current detection unit 7 is connected to the first rectification smoothing unit 4.

The one ends (anodes) of the capacitors C1 to C4 configuring the first rectification smoothing unit 4 are connected to the current detection unit 7 and are connected (grounded) to the ground through the current detection resistance Rs. Each of the other ends (cathodes) of the capacitors C1 to C4 is connected to respective anodes of the diodes D1 to D4 and cathode side of the LED load group 5. Each of the cathodes of the diodes D1 to D4 is connected to respective terminals of the current balancing unit 3. That is, potentials of the other ends (cathodes) of the capacitors C1 to C4 are more negative than the ground potential.

One end of the reactor L configuring the power control unit 6 is connected to the output terminal of the third rectification smoothing unit 10, and another end of the reactor L is connected to the anode of the diode D and one terminal of the switching device Q. The cathode of the diode D is connected to one end of the capacitor C0 and anodes of the LED loads LD1 to LD4. Since other end (cathode) of the capacitor C0 is connected to the other terminal of the switching device Q and the ground, a midpoint potential between a potential at the other end (cathode) of the capacitor C0 and potentials of the other ends of the capacitors C1 to C4 is substantially equal to the ground potential.

The current detection unit 7 has the detection resistance Rs and the error amplifier, which are connected to the diodes D1 to D4 and capacitors C1 to C4 of the first rectification smoothing unit 3. The current detection unit 7 detects the currents flowing in the diodes D1 to D4 and capacitors C1 to C4 at a time and outputs a difference with respect to a predetermined current value to the power control unit 6 as a current detection signal.

The power control unit 6 of this illustrative embodiment converts the output voltage of the third rectification smoothing unit 10 in response to the current detection signal to control the anode voltages of the LED loads LD1 to LD4, thereby controlling the LED load group 5 with desired brightness.

The LED driving apparatus 300 of this illustrative embodiment can control the brightness of the LED load group 5 and balance the currents flowing in the respective LED loads LD1 to LD4, like the LED driving apparatus 100 of the first illustrative embodiment. Further, since cathode potentials of the LED load group 5 become lower than the ground potential (potential of the housing), it is possible to make anode potentials of the LED load group 5 with respect to the ground potential lower than those of the first illustrative embodiments. Accordingly, the LED driving apparatus 300 of this illustrative embodiment can reduce an insulation distance with respect to the ground (housing).

Fourth Illustrative Embodiment

Figure 6:
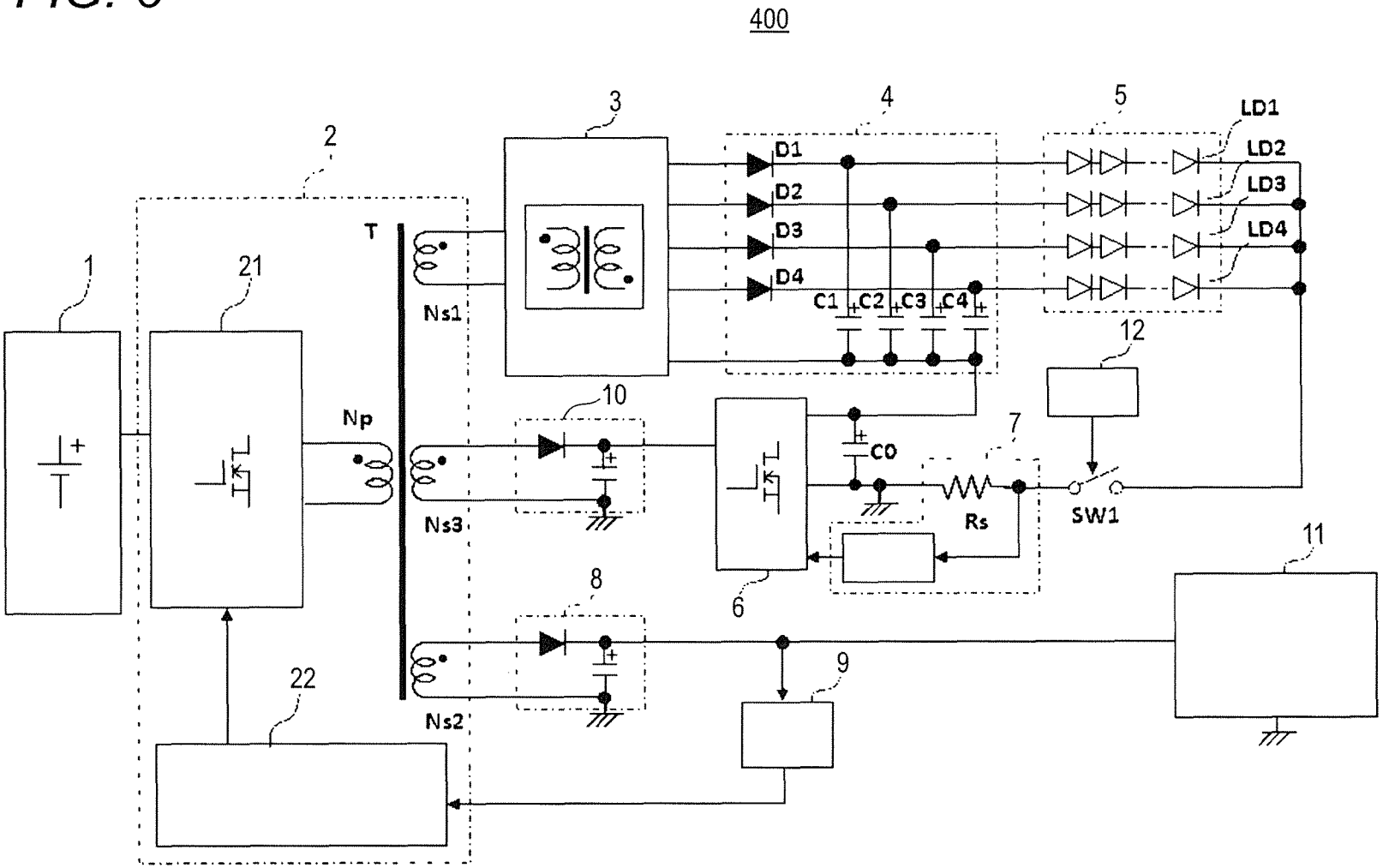
FIG. 6 is a circuit diagram of an LED driving apparatus according to a fourth illustrative embodiment of the invention.

FIG. 6 is a circuit diagram of an LED driving apparatus 400 according to a fourth illustrative embodiment of the invention. The LED driving apparatus 400 is different from the LED driving apparatus 100 of the first illustrative embodiment in that a switch SW1 is connected between the LED load group 5 and the current detection unit 7, and a switch control unit 12 for controlling the switch SW1 is provided.

The switch SW1 and the switch control unit 12 are provided to perform the PWM dimming for the LED load group 5 by intermittently controlling the DC current flowing in the LED load group 5. The switch SW1 consists of a transistor or MOSET and has a control terminal to which the output signal (PWM signal) of the switch control unit 12 is input.

The switch control unit 12 modulates a duty ratio (ON width) of the PWM signal and then outputs the modulated PWM signal to the control terminal of the switch SW1, based on an external signal input from the outside of the LED driving apparatus 400, for example. The switch SW1 and the switch control unit 12 may be connected between the capacitor of the first rectification smoothing unit 3 and the detection resistance Rs.

The LED driving apparatus 400 of this illustrative embodiment can control the brightness of the LED load group 5 and balance the currents flowing in the respective LED loads LD1 to LD4, like the LED driving apparatus 100 of the first illustrative embodiment. Further, the LED driving apparatus can precisely control the DC current flowing in the LED load group 5.

Figure 7:
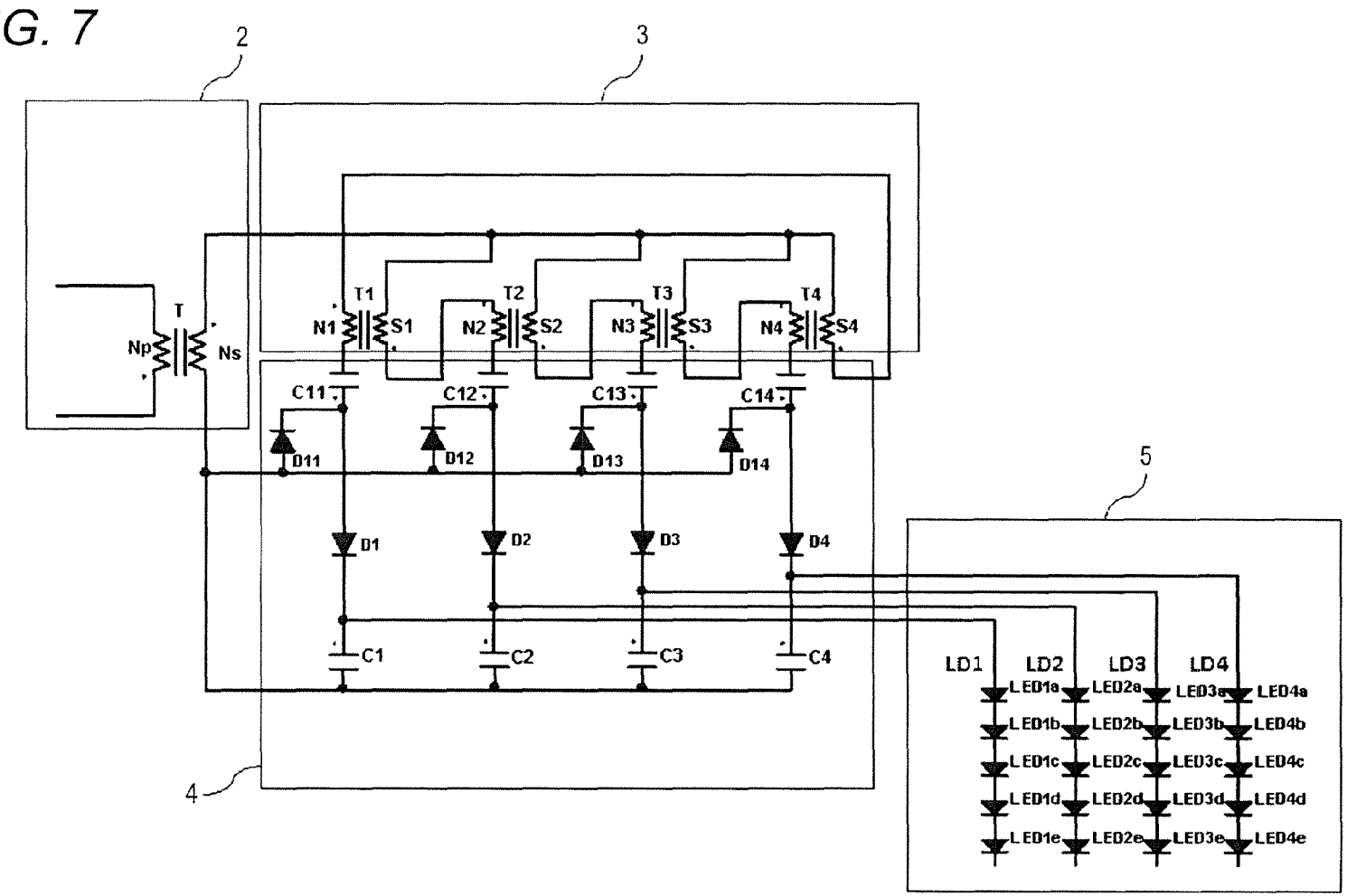
FIG. 7 is a detailed circuit diagram of a current balancing unit and a first rectification smoothing unit.

FIG. 7 is a detailed circuit diagram of the current balancing unit 3 and the first rectification smoothing unit 4 in the LED driving apparatus of the invention.

The first secondary coil Ns1 is connected with: a first series circuit having a first half-wave voltage-doubled rectifier circuit consisting of a coil S4, a coil N1, capacitors C1, C11 and diodes D1, D11; a second series circuit having a second half-wave voltage-doubled rectifier circuit consisting of a coil S1, a coil N2, capacitors C2, C12 and diodes D2, D12; a third series circuit having a third half-wave voltage-doubled rectifier circuit consisting of a coil S2, a coil N3, capacitors C3, C13 and diodes D3, D13; and a fourth series circuit having a fourth half-wave voltage-doubled rectifier circuit consisting of a coil S3, a coil N4, capacitors C4, C14 and diodes D4, D14. In other words, the first rectification smoothing unit 4 consists of a voltage doubler rectifier circuit, and the LED loads LD1 to LD4 are connected to outputs of the first to fourth half-wave voltage-doubled rectifier circuits.

The coil N1 (N2, N3, N4) and the coil S1 (S2, S3, S4) are magnetically coupled so that the half-wave rectified current of the diode is balanced, thereby configuring the transformer T (T2, T3, T4). In other words, each series circuit has two coils that are connected in series, and each of the two coils is electromagnetically coupled as primary and secondary coils of the transformer. Since the primary coil N1 (N2, N3, N4) and the secondary coil S1 (S2, S3, S4) of the transformer T1 (T2, T3, T4) are magnetically coupled, the capacitors C1 to C4 are charged with the same current. Accordingly, the balanced currents flow in the LED loads LD1 to LD4 that are connected to the capacitors C1 to C4, even when the impedances thereof are different.

Figure 8:
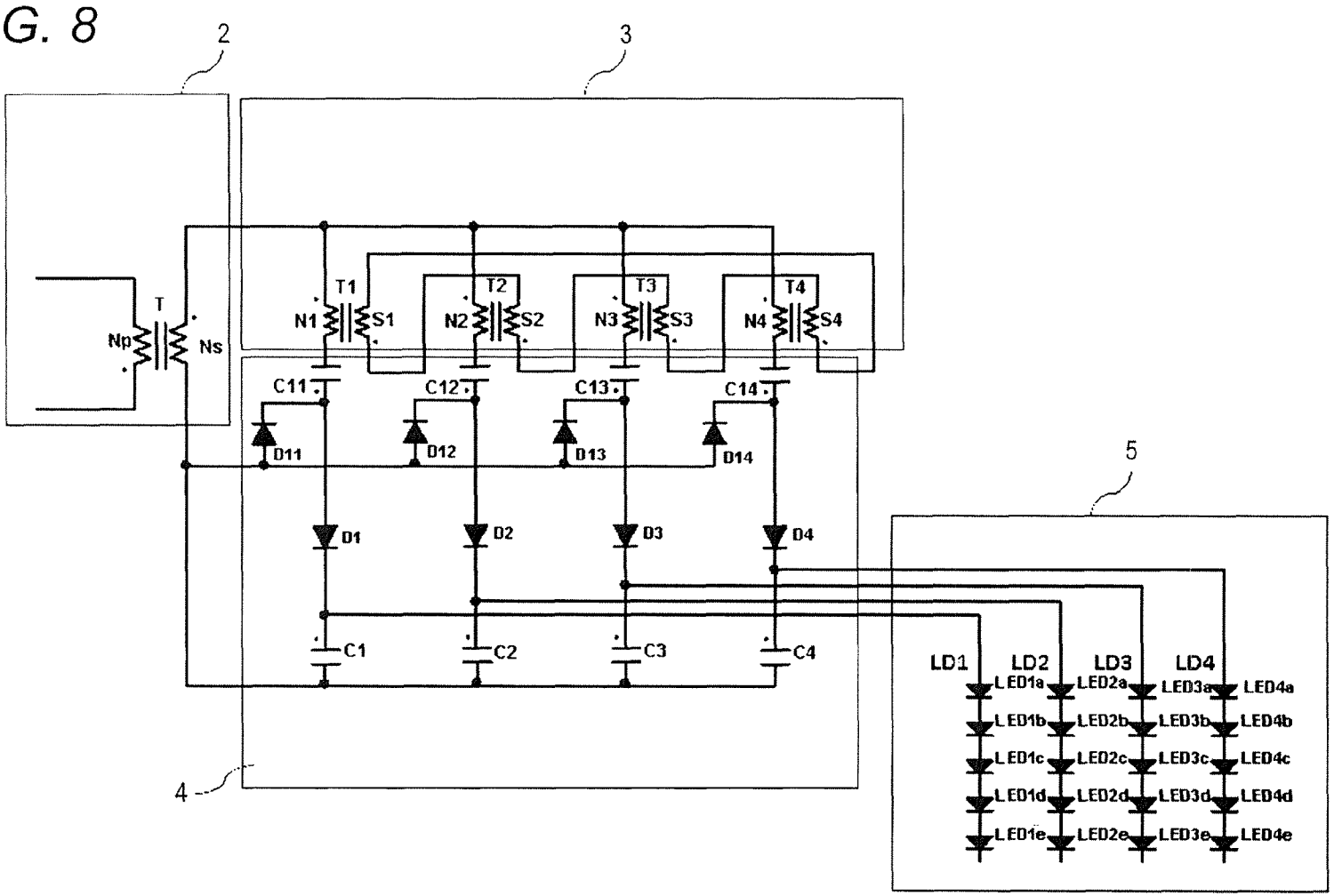
FIG. 8 is a modified circuit diagram of the current balancing unit and the first rectification smoothing unit.

FIG. 8 is a modified circuit diagram of the current balancing unit 3 shown in FIG. 7.

The first secondary coil Ns1 is connected with: a first series circuit having a first half-wave voltage-doubled rectifier circuit consisting of a coil N1, capacitors C1, C11 and diodes D1, D11; a second series circuit having a second half-wave voltage-doubled rectifier circuit consisting of a coil N2, capacitors C2, C12 and diodes D2, D12; a third series circuit having a third half-wave voltage-doubled rectifier circuit consisting of a coil N3, capacitors C3, C13 and diodes D3, D13; and a fourth series circuit having a fourth half-wave voltage-doubled rectifier circuit consisting of a coil N4, capacitors C4, C14 and diodes D4, D14.

The coil S1, the coil S2, the coil S3 and the coil S4 are connected in a closed loop, and the coil N1 (N2, N3, N4) and the coil S1 (S2, S3, S4) are electromagnetically coupled, thereby configuring the transformers T1 to T4. In other words, each series circuit has one coil, the coils electromagnetically coupled to each coil are connected in series to configure a closed loop, and the same current flows in the coil S1, the coil S2, the coil S3 and the coil S4.

Figure 9:
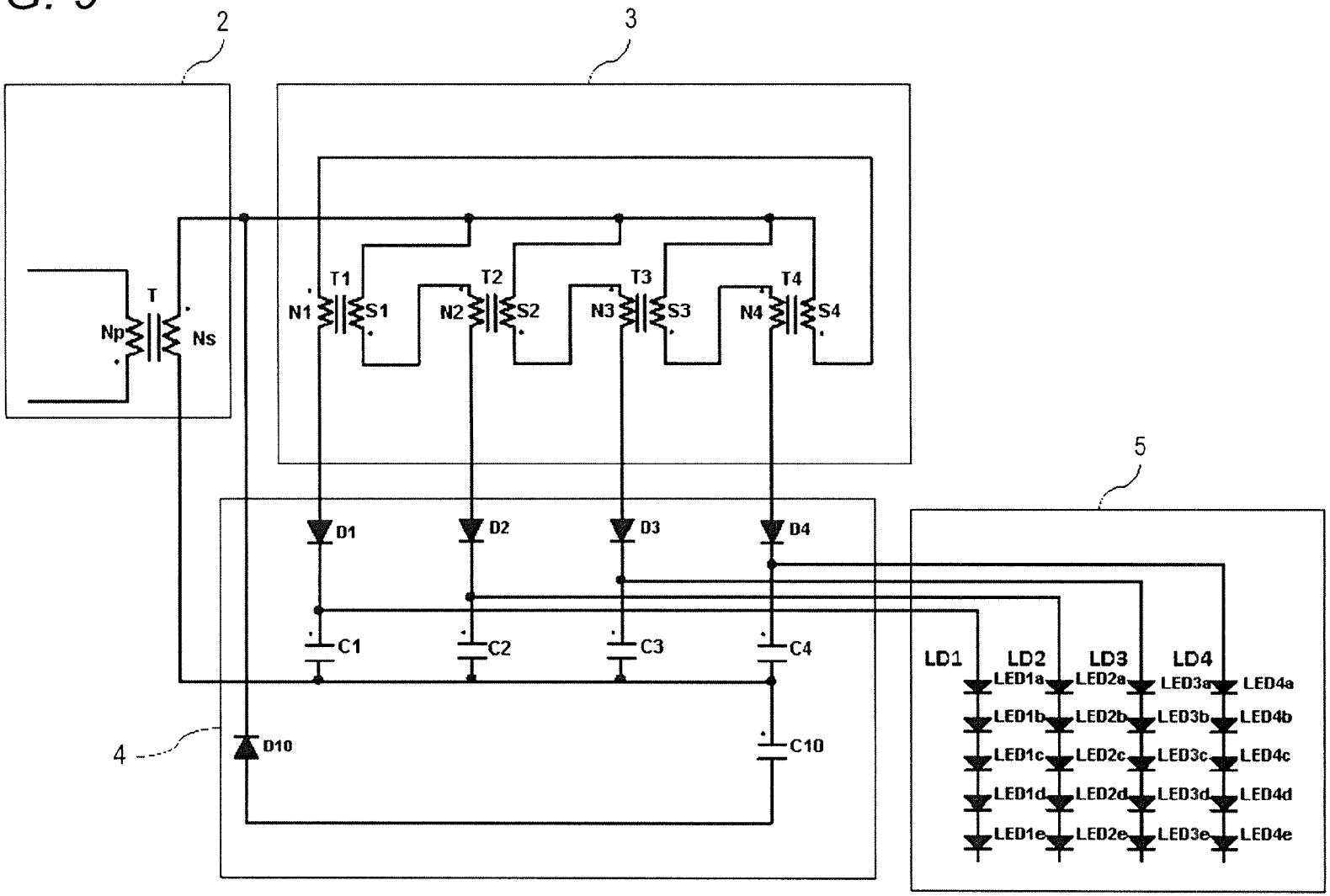
FIG. 9 is another modified circuit diagram of the current balancing unit and the first rectification smoothing unit.

FIG. 9 is another modified circuit diagram of the first rectification smoothing unit 4 shown in FIG. 7.

The first secondary coil Ns1 is connected with: a first series circuit having a first half-wave rectifier circuit consisting of a coil S4, a coil N1, a capacitor C1 and a diode D1; a second series circuit having a second half-wave rectifier circuit consisting of a coil S1, a coil N2, a capacitor C2 and a diode D2; a third series circuit having a third half-wave rectifier circuit consisting of a coil S2, a coil N3, a capacitor C3 and a diode D3; and a fourth series circuit having a fourth half-wave rectifier circuit consisting of a coil S3, a coil N4, a capacitor C4 and a diode D4. Further, the capacitors C1 to C4 are connected with the coils S1 to S4 through a series circuit configured by a capacitor C10 and a diode D10. In other words, the first rectification smoothing unit 4 includes the half-wave rectifier circuits, and the LED loads LD1 to LD4 are connected to outputs of the first to fourth half-wave rectifier circuits.

As described above, by connecting the series circuit configured by the capacitor C10 and the diode D10, it is possible to supply the current of a period, during which current does not flow in the half-wave rectifier circuits, to the LED load group 5 through the series circuit.

Figure 10:
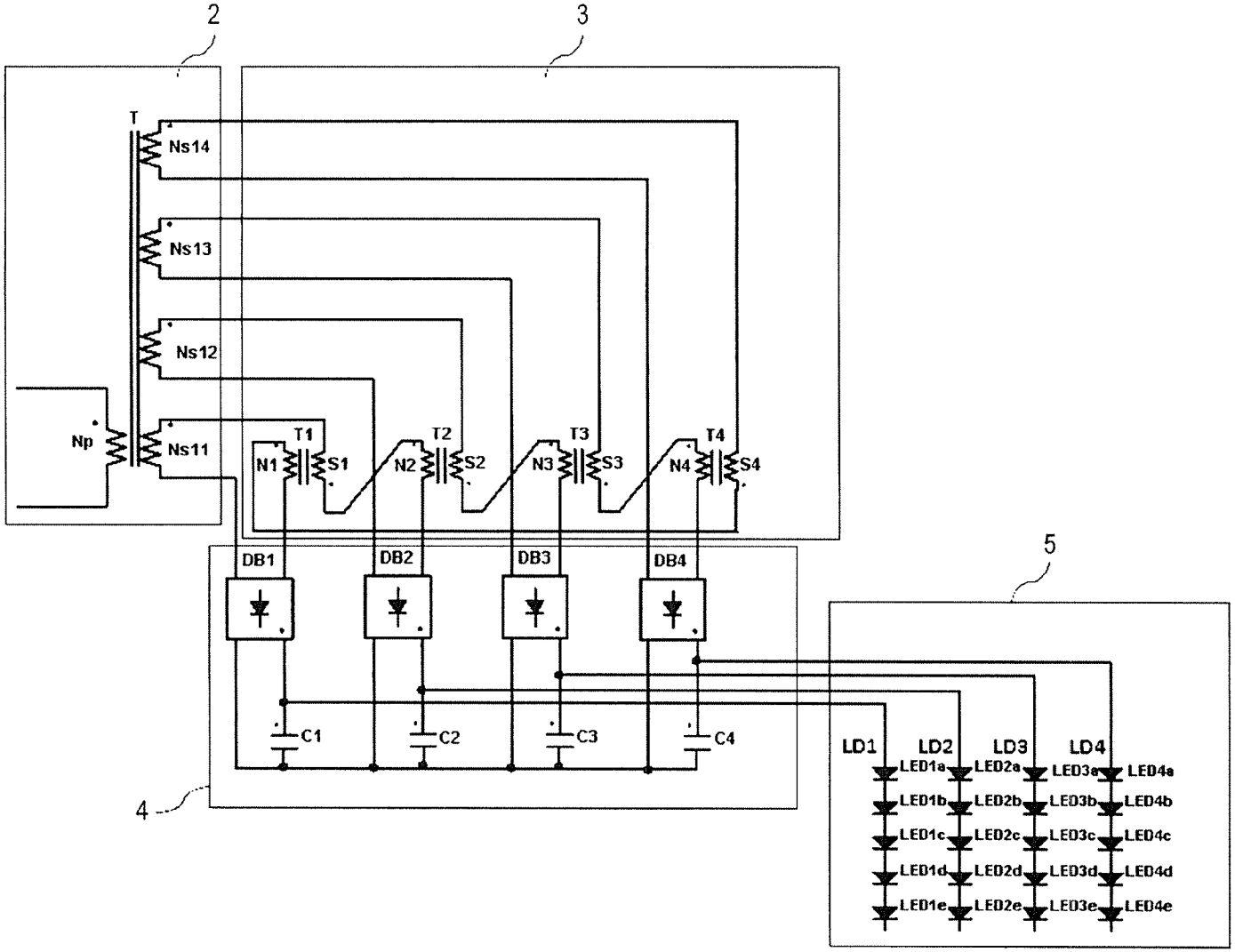
FIG. 10 is still another modified circuit diagram of the current balancing unit and the first rectification smoothing unit.

FIG. 10 is still another modified circuit diagram of the power supply unit 2 and the first rectification smoothing unit 4 shown in FIG. 7.

The first secondary coil Ns1 is divided into coils Ns11 to Ns14 so as to correspond to the LED loads LD1 to LD4. The coil Ns11 is connected with a first series circuit having a first full-wave rectifier circuit consisting of a coil S1, a coil N2, a capacitor C2 and a diode bridge DB2. The coil Ns12 is connected with a second series circuit having a second full-wave rectifier circuit consisting of a coil S2, a coil N3, a capacitor C3 and a diode bridge DB3. The coil Ns13 is connected with a third series circuit having a third full-wave rectifier circuit consisting of a coil S3, a coil N4, a capacitor C4 and a diode bridge DB4. The coil Ns14 is connected with a fourth series circuit having a fourth full-wave rectifier circuit consisting of a coil S4, a coil N1, a capacitor C1 and a diode bridge DB1. In other words, it is possible to half-wave rectify the alternating power, which is output from the power supplying unit 2, and to supply the same to the LED load group 5.

Although the illustrative embodiments of the invention have been described, it should be noted that the invention is not limited to the illustrative embodiments. In other words, the illustrative embodiments can be variously changed and modified within the scope of the invention defined in the claims. For example, the LED devices configuring the LED loads LD1 to LD2 are not limited to the white LEDs and may be LED devices of red (R), green (G), blue (B) and the like. In addition, the series number of the LED devices may be different for each system. Also, the power supplying unit 2 may be configured by a switching power supply apparatus of a fly back type or switching power supply apparatus of an active clamp type.

What is claimed is:

1. An LED driving apparatus comprising:

a power supplying unit, which includes a transformer having a primary coil and a plurality of secondary coils, and which outputs alternating power from the plurality of secondary coils;

a first series connector that is configured by a first coil and a first rectification smoothing circuit connected to a first secondary coil of the plurality of secondary coils;

a first LED load, which includes a plurality of LEDs connected in series, and to which power smoothed from the first rectification smoothing circuit is supplied;

a second series connector that is configured by a second coil and a second rectification smoothing circuit connected to the first secondary coil;

a second LED load, which includes a plurality of LEDs connected in series, and to which power smoothed from the second rectification smoothing circuit is supplied;

a power control unit that controls power to be supplied to the first and second LED loads based on currents flowing in the first and second LED loads; and a direct current load that is connected to both ends of a second secondary coil of the plurality of secondary coils, wherein the first and second coils are electromagnetically coupled to each other, and wherein the power supplying unit controls the alternating power based on the power supplied to the direct current load.

2. The LED driving apparatus according to claim 1, wherein the first and second rectification smoothing circuits are voltage doubler rectifier circuits having a plurality of diodes and a plurality of capacitors.

3. The LED driving apparatus according to claim 1, further comprising:

a current detection unit that detects the currents flowing in the first and second LED loads at a time and outputs a current detection signal, wherein the power control unit controls the power to be supplied to the first and second LED loads based on the current detection signal.

4. The LED driving apparatus according to claim 1, wherein the power control unit has a boost chopper circuit that converts the alternating power into a predetermined voltage.

5. The LED driving apparatus according to claim 1, further comprising:

a load voltage detection unit that detects a voltage to be supplied to the direct current load and outputs a voltage detection signal, wherein the power supplying unit controls the alternating power based on the voltage detection signal.

6. The LED driving apparatus according to claim 1, wherein the transformer has a third secondary coil, and wherein the power control unit is connected to the third secondary coil.

* * * * *